US010066454B2

(12) United States Patent
Hross et al.

(10) Patent No.: US 10,066,454 B2
(45) Date of Patent: Sep. 4, 2018

(54) GROUND WORKING TOOL AND METHOD FOR ITS OPERATION

(71) Applicant: BAUER Spezialtiefbau GmbH, Schrobenhausen (DE)

(72) Inventors: Helmut Hross, Schrobenhausen (DE); Ronny Dahl, Schrobenhausen (DE); Manuel Magpatoc Bernadez, Kuala Lumpur (MY)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 290 days.

(21) Appl. No.: 14/953,482

(22) Filed: Nov. 30, 2015

(65) Prior Publication Data

US 2016/0177645 A1 Jun. 23, 2016

(30) Foreign Application Priority Data

Dec. 17, 2014 (EP) ..... 14198622

(51) Int. Cl.
*E21B 25/10* (2006.01)

(52) U.S. Cl.
CPC ..... *E21B 25/10* (2013.01)

(58) Field of Classification Search
CPC ..... E21B 25/10
USPC ..... 175/249–254
See application file for complete search history.

(56) References Cited

U.S. PATENT DOCUMENTS 650,686 A * 5/1900 Leaske ..... E21B 25/00 175/237
1,995,336 A 3/1935 Wright
4,946,000 A * 8/1990 Gibson ..... E21B 25/00 175/251

FOREIGN PATENT DOCUMENTS

DE 34 24 734 A1 2/1986
DE 36 11 014 A1 10/1987
RU 2 182 216 C2 5/2002

OTHER PUBLICATIONS

European Seach Report issued in Application No. 14 19 8622, dated Jun. 29, 2015.

* cited by examiner

*Primary Examiner* — David J Bagnell
*Assistant Examiner* — Brandon M Duck
(74) *Attorney, Agent, or Firm* — Studebaker & Brackett PC

(57) ABSTRACT

A ground working tool comprising a tubular base body with an inner receiving space for receiving a cylindrical core of solid ground material, connector mechanism for connecting the tubular base body with a rotary drive and locking mechanism for locking the core in the receiving space of the tubular base body. The locking mechanism involves at least one locking unit having a guide rail being disposed at an inner side of the tubular base body and arranged with a deviation angle relative to a tangential direction of the tubular base body and the locking unit further comprises at least one locking element, which is moveably mounted on the guide rail between a radially outer releasing position and a radially inner locking position, in which the core is clamped within the receiving space by means of the at least one locking element.

14 Claims, 4 Drawing Sheets

GROUND WORKING TOOL AND METHOD FOR ITS OPERATION

Figure 1A:
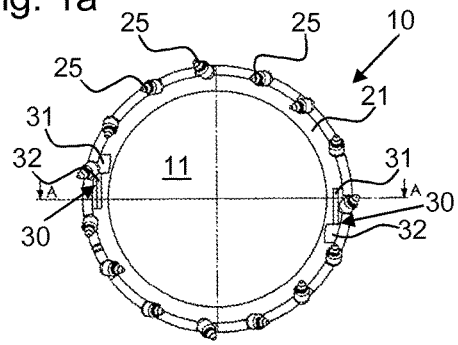

The invention relates to a ground working tool according to the preamble of claim 1 as well as to a method for operating a ground working tool according to the preamble of claim 10.

A ground working tool in accordance with the invention comprises a tubular base body with an inner receiving space for receiving a cylindrical core of solid ground material, connecting means for connecting the tubular base body with rotary drive means, and locking means for locking the core in the receiving space of the tubular base body.

In the method according to the invention for ground working a cylindrical core of solid ground material is received within a receiving space of a tubular base body of a ground working tool. Such a ground working tool is also known as a core catcher.

A ground working tool of the stated type is known from DE 36 11 014 A1 which discloses a core retaining device with a coring barrel.

RU 2 182 216 C2 discloses a core catcher applicable for catching, braking-off and holding a core in a core receiver.

Coring comprises the drilling and removal of core samples of rock from a bore hole in particular a core of solid ground material e.g. in form of a solid cylinder. This core remains in the drilling hole until it is loosened from the ground below and removed e.g. by a core catcher.

Once the core is removed from the drill hole the core needs to be released from the core catcher. Conventional means for holding the core in the core catcher render it necessary to dismantle the core catcher for discharging the core from the device.

The invention is based on the object to provide a ground working tool and a method for ground working, which enable a particularly economical and reliable removal of a core from a bore hole.

In accordance with the invention the objective is achieved by a ground working tool having the features of claim 1 and by a method for ground working having the features of claim 10. Preferred embodiments of the invention are stated in the respective dependent claims.

According to the invention the ground working tool is characterized in that the locking means comprises at least one locking unit having a guide rail being disposed at an inner side of the tubular base body and arranged with a deviation angle relative to a tangential direction of the tubular based body, and the locking unit further comprises at least one locking element, which is moveably mounted on the guide rail between a radially outer releasing position and a radially inner locking position, in which the core is clamped within the receiving space by means of the at least one locking element.

According to the invention the method for ground working is characterized in that the tubular base body is rotated in a locking direction wherein at least one locking element on a guide rail of at least one locking unit of locking means at the inner side of the tubular base body is moved from a radially outer releasing position to a radially inner locking position, in which the core is clamped within the receiving space by means of the at least one locking element.

A first fundamental idea of the invention can be seen in the fact that for catching a core of solid ground material from a bore hole a locking element is movably mounted within a cylindrically shaped ground working tool receiving the core whereby the locking element, having at least two mounting positions, is moveably mounted inside the ground working tool. In one mounting position the core is clamped within the receiving space of the ground working tool by means of the at least one locking element. In a different mounting position no clamping of the core is caused by means of the at least one locking element within the receiving space. While the at least one locking element radially clamps the core within the receiving space the radial distance of the locking element from the tubular base body is enlarged in comparison to its non-locking position.

In general, the locking element can be moved by a drive, e.g. a hydraulic cylinder.

In particular, it is preferred that by rotation of the tubular base body in a locking rotation direction the core may pull by friction the locking element into its radially inner locking position. When displaced into a radially inner locking position, the at least one locking element is pressed against the core. By subsequent rotation of the tubular base body in an opposite drilling rotation direction the core pushes the locking element into its radially other releasing position. The core is released from the fixation by the clamping units.

In a preferred embodiment of a ground working tool two or more locking units are provided. The individual locking units may be disposed at any position at an inner side of the tubular base body.

According to an embodiment of the invention it is preferred that a first locking unit and a second locking unit are provided, the first locking unit and the second locking unit are arranged in radially opposite manner. The opposing arrangement of individual locking units may help to securely clamp a core of solid ground material within the tubular base body. A connecting line between a first locking unit and a second locking unit may go approximately through the center axis of the core. This may allow for a particularly good distribution of the required clamping force between the clamping units. However, any other arrangement of locking units at an inner side of the tubular base body in which the locking units share the task of holding the core in a particularly mutual fashion may be used for the ground working tool.

According to a preferred embodiment the first locking unit is arranged in a lower portion nearby a lower opening of the tubular base body and the second locking unit is arranged at an upper portion of the tubular base body. The individual locking units are arranged at different levels within the tubular base body. This may allow for a particularly slip-prove clamping of the core within the tubular base body. However, the arrangement of locking units within tubular base body of the ground working tool is not restricted to this embodiment. It is also feasible to arrange more than two locking units within the tubular base body. It is especially advantageous that the locking units are arranged in two groups of locking units, comprising locking units in an upper portion and locking units in a lower portion of the tubular base body. Preferably the group of locking units in an upper portion and a lower portion are organized in different half-spaces of the tubular base body.

In an advantageous embodiment of the invention the locking element is designed as a metal slide having a contact surface, which is provided with wear-resistant plating. The locking element is slidable along the guide rail between the radially outer releasing position and the radially inner locking position. Preferably the locking element is in constant contact with the core independently of the position of the metal slide. For instance, when the tubular base body is rotated around the core in a locking rotation direction, the metal slight may be pulled from the radially outer releasing position to the radially inner locking position. The high abrasive forces which may occur during a repositioning of the metal slide may be buffered by provision of wear-resistant plating on the contact area between the core and the metal slight. Preferably, the ware-resistant plating is of at least one abrasive resistant metal in particular of an abrasive resistant alloy such as e.g. steel, stellite, widia.

In an advantageous embodiment of the invention the ground working tool is designed as a drilling tool having ground removal elements at the lower end of the tubular base body. The ground removal elements cut into the ground and form a cylindric core received within the tubular base body. The ground removal elements may be horizontally and vertically orientated at different angles in a drilling rotation direction. Some of the cutting elements may be orientated inwardly towards the core to be received within the tubular base body. Consequently, the core, formed by the ground working tool during drilling operations, may be spaced from the inner surface of the tubular base body by a certain distance. The diameter of the received core may be smaller than the inner circle diameter of the tubular base body. In other words the volume of the core may be smaller than the volume of the tubular base body of the ground working tool.

According to a preferred embodiment of the invention the ground removal elements are designed as cutting teeth, drill bits and/or rolling bits. Ground removal elements of the stated type are particularly effective at working in solid grounds. Any other type of ground removal elements applicable to the task of cutting into solid ground may be used for the inventive ground working tool. Preferably, a combination of different ground removal elements is applied.

A preferred embodiment of the invention is obtained in that the drilling tool is rotatable in a first drilling direction, wherein the locking element is displaced in the releasing position, and the locking element is displaced into the locking position when the drilling tool is rotated reversely in a second locking direction. When rotating the tubular base body of the ground working tool about an axis of rotation, the core within the tubular base body may be in contact with the at least one locking element. Upon rotation of the tubular base body the core may push or pull the locking element accordingly into the releasing or locking position depending on the direction of rotation.

According to the invention it is preferred that by the locking means having two radially opposite and axially displaced locking units breaking forces are exertable transversely to a longitudinal axis of the cylindrical core. Rotation of the tubular base body in a locking rotation direction pulls the locking units successively along the guide rail radially towards the received core. The locking forces between the locking element and the core may eventually be strong enough to result in a breaking force breaking off the cylindrical core from the ground below. The locking forces of the individual locking units may be applied to the core in opposite directions and different heights of the core within the tubular base body.

According to the invention it is particularly preferred that by means of a first locking unit being arranged in a lower portion nearby a lower opening of the tubular base body and a second locking unit being arranged at an upper portion of the tubular base body breaking forces are exerted onto the core transversely to a longitudinal axis of the cylindrical core. Locking elements organized in the above-described way may impose clamping forces in their respective radially inner locking positions in relatively opposing directions at different heights. Consequently, shear forces may be applied to the received core by means of the first locking unit and the second locking unit being arranged in the above-described manner. Accordingly, the core may be subject to a bending movement away from a straight orientation within the tubular base body towards an inclined orientation.

A preferred embodiment of the inventive method is obtained in that the ground working tool comprising ground removal elements at the lower end of the tubular base body is rotatably driven in a first drilling direction into the ground, wherein a bore hole with a cylindrical core of solid ground material is formed and the locking element of the at least one locking unit is displaced into the releasing position, and after the core is formed, the ground working tool is rotated reversely in a second locking direction, wherein the core is clamped within the receiving space of the tubular base body. While the tubular base body of the ground working tool is rotated in a first drilling direction the cylindrical core may be formed by the ground removal elements at the lower end of the tubular base body. When the emerging core reaches a locking element on the guide rail, independently from its current position, the locking element may be shifted by the core to its radially outer releasing position. Once the emerged cylindrical core is receive within the tubular base body, reverse rotation in a second locking rotation direction may displace the locking elements into the respective radially inner locking position by means of the formed core.

Furthermore, a preferred embodiment is obtained in that the core is separated from the ground by moving the locking elements of at least two radially opposed and axially displaced locking units into the locking position, wherein breaking forces traversely to a longitudinal axis of the cylindrical core are exerted for separating the core from the ground. Rotation of the tubular base body in a second locking rotation direction may press the locking elements against the core sufficiently intends to cause a breaking of the core.

According to the invention it is particularly preferred that the ground working tool together with the core clamped inside the receiving space of the tubular base body are removed out of the bore hole by lifting the ground working tool. Once the core of solid ground material is loosened from the soil below and clamped within the tubular base body the core may be lifted out of the bore hole by means of the ground working tool. After removal of the core from the bore hole, the core may be released from the tubular base body of the ground working tool by displacement of the locking elements in a radially outer releasing position. This may be achieved by abruptly rotating the tubular base body in drilling direction. An abrupt movement of the tubular base body may cause a delayed rotation of the received core with respect to the tubular base body due to the mass inertia of the core. The relative movement of tubular base body and core may displace the locking elements in a radially outer releasing position. Alternatively the cylindrical core may be held e.g. at a bottom end by a clamp or a similar fixation tool while rotating the ground working tool in releasing drilling rotation direction. Once the locking elements are in the radially outer releasing position, the core is released from its jammed fixation by the locking elements.

Figure 1B:
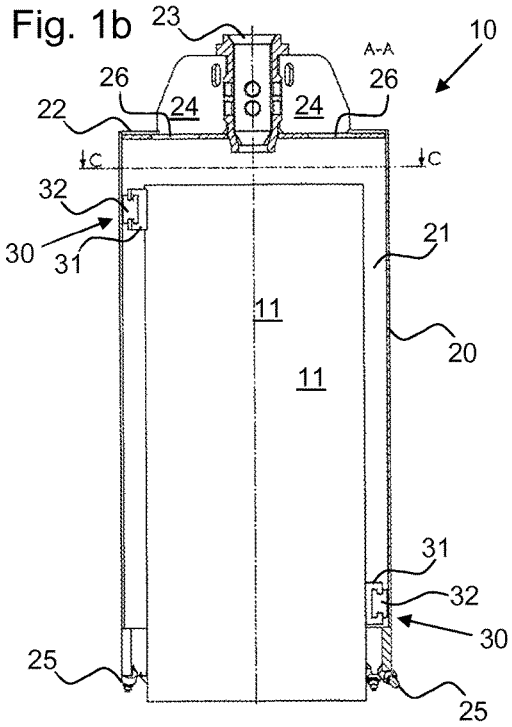

In the following the invention will be described further by way of preferred embodiments which are illustrated schematically in the accompanying drawings, wherein show:

FIG. 1*a*: a plan view of the bottom side of an inventive ground working tool with a released core;

FIG. 1*b*: a cross-sectional view of the ground working tool according to section A-A of FIG. 1*a;*

Figure 1C:
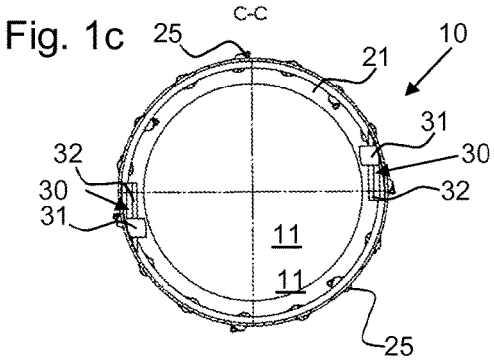

FIG. 1*c*: a cross sectional view of the ground working tool according to section C-C of FIG. 1*b;*

Figure 2A:
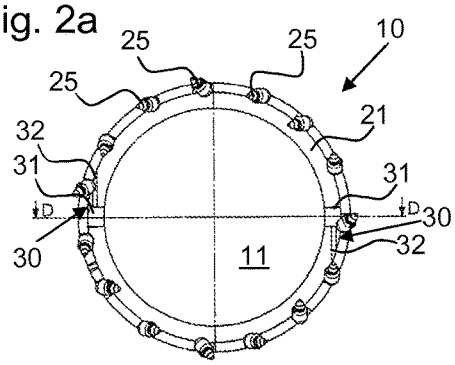
Figure 2B:
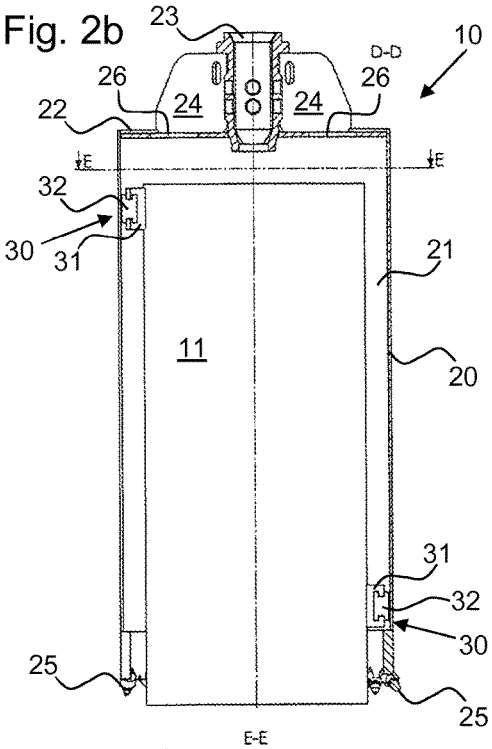

FIG. 2*a*: a plan view of the bottom side of the ground working tool of FIG. 1*a* to 1*c* with a clamped core;

FIG. 2*b*: a cross sectional view of the ground working tool according to section D-D of FIG. 2*a;*

Figure 2C:
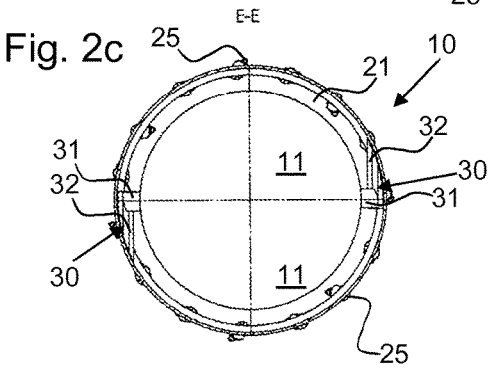

FIG. 2*c*: a cross sectional view of the ground working too according to section EE of FIG. 2*b;*

Figure 3:
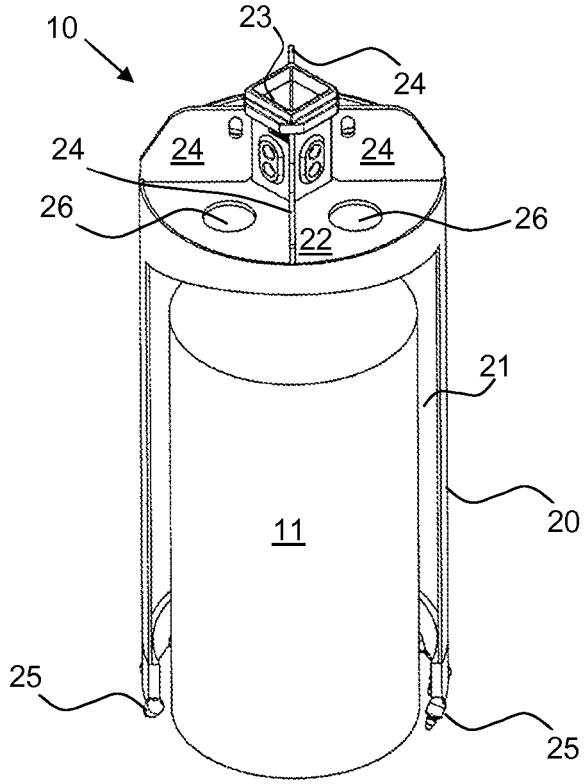
Figure 4:
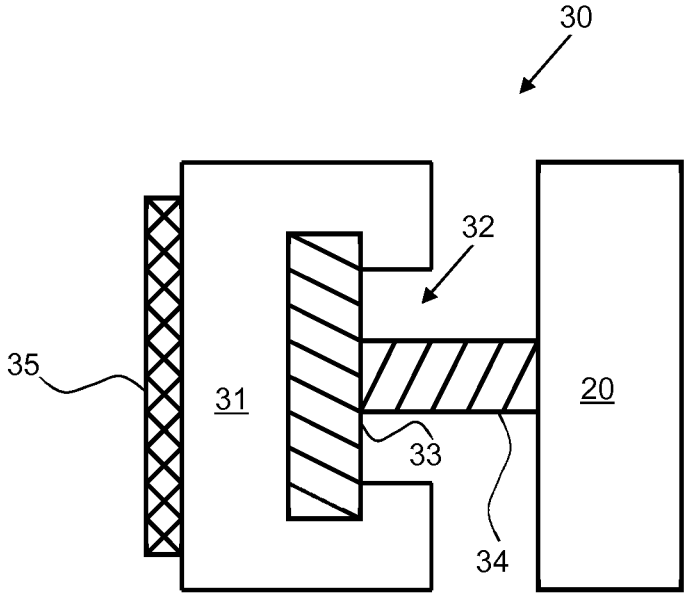
Figure 5:
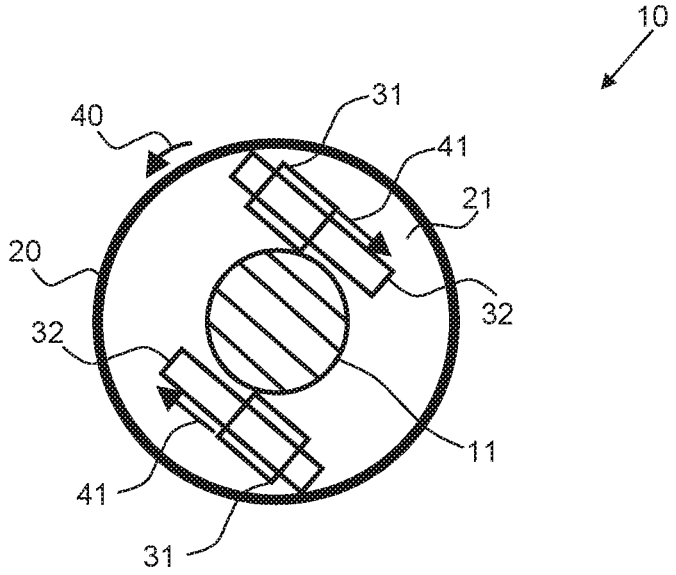
Figure 6:
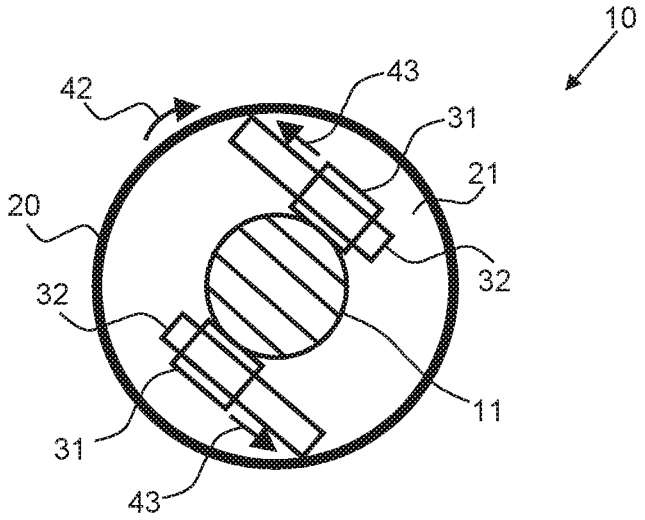

FIG. 3: a perspective view of the tubular base body with a received core of solid ground material (displayed without the locking elements);

FIG. 4: a schematic cross-sectional view of a locking element arranged on a guide rail;

FIG. 5: schematic axial view of the locking elements on a horizontal plane displaying the process of locking between locking elements and the core;

FIG. 6: schematic axial view on a horizontal plane displaying the process of releasing between the locking elements and the core; and FIG. 7 a schematic cross-sectional view of the tubular base body with a received core of solid ground material showing the braking of the cylindrical core from the soil below.

Elements corresponding to each other are designated in all figures with the same reference signs.

A ground working tool 10 according to the invention is shown in FIGS. 1 and 2. The ground working tool 10 comprises a tubular base body 20 which has a cylindrical shape and about the same diameter over its whole length. On the top end of the tubular base body 20 a cover plate 22 is arranged which covers the top opening of the tubular base body 20. The cover plate 22 accurately fits into the inner diameter of the tubular base body and is fixated to the tubular base body 20. On the cover plate 22 a connecting means 23 is centrically arranged with an upward projecting opening for receiving a drive shaft such as a Kelly-bar. Additionally on the cover plate 22 retaining plates 24 are disposed which extend along the connecting means 23 perpendicular to the cover plate 22. The retaining plates 24 are fixed to the cover plate 22 and the connecting means 23. A bottom end the tubular base body 20 is opened. On a front edge of the lower end of the tubular base body 20 ground removal elements 25 are circumferentially organized around the opening of the tubular base body 20. The ground removal elements 25 are orientated at different angles in a drilling rotation direction. Thereby, some of the ground removal elements 25 are pointing away from of the tubular base body 20 whereby other ground removal elements 25 are pointing inwards in direction of the received core of solid ground material 11. Further ground removal elements 25 point in tangential direction of the tubular base body 20. The ground removal elements 25 which feature the most inwardly projecting orientation define the diameter of the formed core 11.

The core 11 is displayed in FIG. 1 being received within the tubular base body 20. At an upper left side and a lower right side of the core 11 locking units 30 are arranged on an inner surface of the tubular base body 20. The core 11 displayed in FIG. 1 has the dimensions, especially the approximately length of a core after the drilling by the ground working tool 10 is completed. The locking unit 30 in an upper left area of the core 11 and the locking unit 30 in a lower right area of the core 11 are arranged in radially opposite and axially displaced manner. By this arrangement the clamping of the core 11 between the locking units 30 can be achieved particularly well.

The locking units 30 comprise a locking element 31 and a guide rail 32. The axial top view and the axial view from below of FIG. 1 show the guide rail 32 fixed to the inner surface of the tubular base body 20 in an angle which deviates from a tangential direction. Hence, one end of the guide rail 32 is closer to the center axis of the tubular base body 20 than the opposite end of the same guide rail 32. Consequently, this also applies to the locking unit 31 when displaced at different ends of the guide rail 32.

The locking element 31 is slidably arranged on the guide rail 32 between a radially inner locking position and a radially outer releasing position. FIG. 1 shows the locking element 31 in the radially outer releasing position. In this position the locking element 31 may loosely contact the received core 11.

FIG. 2 shows the same preferred embodiment of the invention as FIG. 1. However, the top view and the view from below the ground working tool 10 show the locking elements 31 in a radially inner locking position jamming the core 11 within the tubular base body 20. In the radially inner locking position the locking element contacts the core 11 in a firm locking engagement.

FIG. 3 displays a perspective view of the ground working tool 10 from an angle above the tubular base body 20. The cover plate 22 of the ground working tool 10 comprise at least one opening 26 which allows for a gas and fluid communication of the inside of the tubular base body 20 with the surrounding environment. Furthermore, the perspective view of the inventive ground working tool 10 in FIG. 3 displays a space 21 between the inner surface of the tubular base body 20 and the outer surface of the received core 11 particularly well (see FIGS. 1, 2 for comparison). Within the space 21 between the core 11 and the tubular base body 20 the locking units 30 are organized which are not shown in this figure, but in FIGS. 1 and 2.

FIG. 4 shows a schematic side view of a locking unit 30. The locking element 31 comprises a wear-resistant plating 35. The plating 35 protects the locking element 31 from premature abrasive damage. The locking element 31 is moveably mounted along a guide rail 32 in a form-locking fashion. The guide rail 32 comprises a horizontal connecting plate 34 which is fixed to the tubular base body 20. On the horizontal connecting plate 34 a vertical contact plate 33 is arranged perpendicularly orientated, whereon the locking element 31 is provided. The horizontal connecting plate 34 is located between the tubular base body 20 and the vertical contact plate 33 which mutually form a "H"-shaped structure.

The locking element 31 may contact the vertical contact plate 33 from four sides. One contact side faces the inner surface of the tubular base body 20, comprising an opening for receiving the horizontal connecting plate 34. A second contact side faces away from the surface of the tubular base body 20 potentially facing the received core 11 within the tubular base body. A third contact side faces towards the cover plate 22 on the upper end of the tubular base body and a fourth side faces downwards towards the opening of the tubular base body 20 at a lower end. Hence, the locking element 31 consequently comprises a "C"-shaped design wherein the "C-opening" holds the horizontal connecting plate 34.

A cross sectional view of the tubular base body 20 centered about an axis of rotation of the ground working tool 10 is shown in FIG. 5. FIG. 5 exemplifies the correlation between the rotation direction of the ground working tool 10 and the resulting displacement of the locking elements 31 on the guide rail 32 caused by a core 11. Once the drilling is completed the core 11 is received within the tubular base body 20 to an extent, that at least the upper left locking unit of FIG. 1 or 2 is even with the core 11. Consequently, at least the locking unit in an upper left portion of the tubular base body and the locking unit in a lower portion nearby a lower opening of the tubular base body may be contacted with the core 11. Rotation of the ground working tool 10 in a locking rotation direction 40 causes a pulling of the locking elements 31 from a displayed radially outer releasing position in direction of a locking displacement 41 by means of the core 11. The resulting radially inner locking position of the locking element 31 is shown in FIG. 6 accordingly.

FIG. 6 shows the same schematic view on the ground working tool as FIG. 5. Here the locking elements 31 are displayed in a radially inner locking position. For releasing the core from the tubular base body 20 of the ground working tool 10 the ground working tool 10 is rotated in a drilling rotation direction 42. Consequently the core 11 pushes the locking elements 31 along the guide rail 32 in direction of a releasing displacement 43 from a radially inner locking position (FIG. 6) to a radially outer releasing position (FIG. 5).

Figure 7:
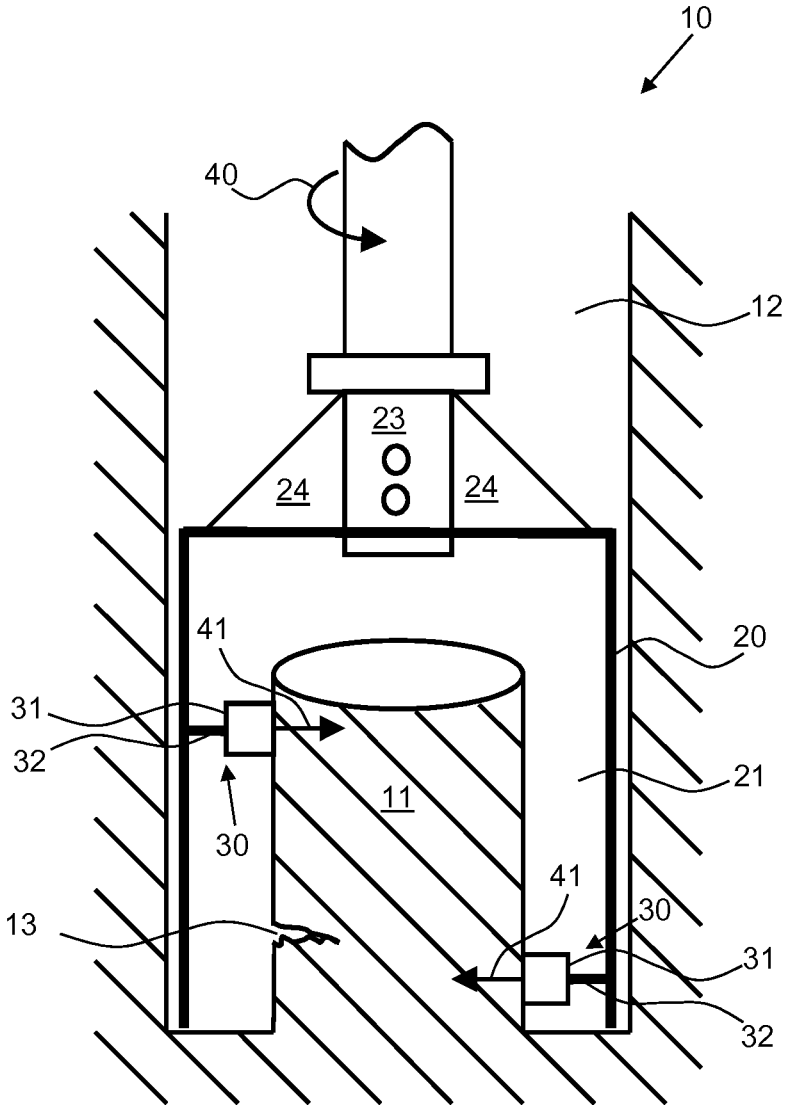

FIG. 7 shows a schematic cross sectional side view of the core 11 within the tubular base body 20 of the ground working tool 10. FIG. 7 illustrates rotation of the ground working tool 10 in a locking rotation direction 40 (see FIG. 5 for comparison). Upon rotation the locking elements 31 are radially inwardly displaced 41 towards an axis of rotation of the ground working tool 10. Consequently, the first locking unit 31 being arranged in a lower portion nearby by an opening of the tubular base body 20 and the second locking unit 31 being arranged at an upper portion of the tubular base body 20 push the core 11 in opposite directions. The resulting sheer forces may cause a crack 13 in the core 11 at its lower end. As long as the core 11 is attached to the ground below the core 11 may be released from the ground working tool 10 by simple rotation of the tubular base body 20 in drilling rotation direction (see FIG. 6). Once, the core 11 is removed from the bore hole 12 (see FIG. 7) the core 11 may either be fixated by e.g. clamping means, so the tubular base body 20 may be rotated around the core 11 in a drilling rotation direction for releasing the core 11 from the tubular base body 20. Alternatively, mass inertia of the core 11 may be exploited for releasing the core 11 from the tubular base body 20 upon abrupt movement of the ground working tool 10 in a drilling rotation direction 42.

The invention claimed is:

1. A ground working tool comprising:

a tubular base body with an inner receiving space for receiving a cylindrical core of solid ground material, a connector that connects the tubular base body with rotary drive means, and locking means for locking the core in the inner receiving space of the tubular base body, wherein the locking means comprises at least one locking unit having a guide rail being disposed inside an inner side of the tubular base body and arranged with a deviation angle relative to a tangential direction of the tubular base body, and the at least one locking unit further comprises at least one locking element, which is moveably mounted on the guide rail between a radially outer releasing position and a radially inner locking position, in which the core is clamped within the inner receiving space by means of the at least one locking element.

2. The ground working tool according to claim 1, wherein two or more locking units are provided.

3. The ground working tool according to claim 1, wherein a first locking unit and second locking unit are provided, the first locking unit and the second locking unit are arranged in radially opposite manner.

4. The ground working tool according to claim 3, wherein the first locking unit is arranged in a lower portion nearby a lower opening of the tubular base body and the second locking unit is arranged at an upper portion of the tubular base body.

5. The around working tool according to claim 1, wherein the at least one locking element is designed as a metal slide having a contact surface, which is provided with a wear-resistant plating.

6. The around working tool according to claim 1, wherein the ground working tool is designed as a drilling tool having ground removal elements at the lower end of the tubular base body.

7. The ground working tool according to claim 6, wherein the ground removal elements are designed as cutting teeth, drill bits and/or rolling bits.

8. The ground working tool according to claim 1, wherein the locking means comprising the at least one locking unit further comprises two radially opposite and axially displaced locking units that transversely exert breaking forces to a longitudinal axis of the cylindrical core.

9. A around working tool comprising:

a tubular base body with an inner receiving space for receiving a cylindrical core of solid around material, a connector that connects for connecting the tubular base body with rotary drive means, and locking means for locking the core in the inner receiving space of the tubular base body, wherein the locking means comprises at least one locking unit having a guide rail, the guide rail being disposed at an inner side of the tubular base body and arranged with a deviation angle relative to a tangential direction of the tubular base body, the at least one locking unit further comprises at least one locking element, which is moveably mounted on the guide rail between a radially outer releasing position and a radially inner locking position, in which the core is clamped within the inner receiving space by means of the at least one locking element, for making a bore hole with the core, the ground working tool is rotatable in a first drilling direction, wherein the at least one locking element is displaced in the releasing position, and the at least one locking element is configured so that the at least one locking element is displaced into the locking position as a result of the ground working tool being rotated reversely in a second locking direction, which is opposite the first drilling direction.

10. A method for ground working, in particular using the ground working tool according to claim 1, the method comprising:

receiving the cylindrical core of the solid ground material within the inner receiving space of the tubular base body of the ground working tool, rotating the tubular base body in a locking direction, wherein the at least one locking element on the guide rail of the at least one locking unit of the locking means at the inner side of the tubular base body is moved from the radially outer releasing position to the radially inner locking position, in which the core is clamped within the inner receiving space by means of the at least one locking element.

11. The method according to claim 10, wherein by means of a first locking unit being arranged in a lower portion nearby a lower opening of the tubular base body and a second locking unit being arranged at an upper portion of the tubular base body, breaking forces are exerted onto the core transversely to a longitudinal axis of the cylindrical core.

12. The method according to claim 10, wherein the ground working tool comprising ground removal elements at the lower end of the tubular base body is rotatably driven in a first drilling direction into the ground, wherein a bore hole with the cylindrical core of the solid ground material is formed and the at least one locking element of the at least one locking unit is displaced into the releasing position, and after the core is formed, the ground working tool is rotated reversely in a second locking direction, wherein the core is clamped within the inner receiving space of the tubular base body.

13. The method according to claim 10, wherein the locking means comprising the at least one locking unit further comprises at least two radially opposed and axially displaced locking units, the core is separated from the ground by moving the locking elements of the at least two radially opposed and axially displaced locking units into the locking position, wherein breaking forces traversely to a longitudinal axis of the cylindrical core are exerted for separating the core from the ground.

14. The method according to claim 10, wherein the ground working tool together with the core clamped inside the inner receiving space of the tubular base body are removed out of the bore hole by lifting the ground working tool.

* * * * *